United States Patent [19]

Martin

[11] Patent Number: 4,475,563

[45] Date of Patent: Oct. 9, 1984

[54] HAIR BRUSH WITH MOVABLE BRISTLE ROWS

[76] Inventor: Donald S. Martin, 3800 Westcliff Rd., S. Fort Worth, Tex. 76109

[21] Appl. No.: 439,871

[22] Filed: Nov. 8, 1982

[51] Int. Cl.[3] ..... A45D 44/18

[52] U.S. Cl. ..... 132/85; 15/159 R

[58] Field of Search ..... 132/9, 85, 136; 15/201, 15/202, 203, 159 R, 159 A, 160, 172; 132/7, 120, 126, 129; D28/13, 15, 10, 12; D4/13, 14, 17, 19

[56] References Cited

U.S. PATENT DOCUMENTS

| | | | |
|---|---|---|---|
| 726,716 | 4/1903 | Maher | 15/201 |
| 1,572,399 | 2/1926 | Lewis | 132/136 |
| 2,435,394 | 2/1948 | Hawley | 15/201 |
| 3,172,139 | 3/1965 | Wire | 15/160 |
| 3,890,984 | 6/1975 | Lesetar . | |
| 3,974,841 | 8/1976 | Weisman . | |
| 4,030,158 | 6/1977 | Blair et al. | 15/159 A |
| 4,076,032 | 2/1978 | Misercola | 132/9 |
| 4,161,050 | 7/1979 | Sasaki | 132/85 |

*Primary Examiner*—Richard J. Apley
*Assistant Examiner*—Carolyn A. Harrison
*Attorney, Agent, or Firm*—James E. Bradley

[57] ABSTRACT

A hair brush has features for placing waves in the hair with the use of a hot air blower. The brush has a body with a filament carrier portion and a handle portion. The filament carrier portion has at least one stationary section and one movable section. Each section has at least one longitudinal row of filaments. The movable section is movable with respect to the stationary section. In one position, the filaments align, and in the other position, the filament are moved out of alignment. A spring urges the movable section to the first position.

4 Claims, 5 Drawing Figures

HAIR BRUSH WITH MOVABLE BRISTLE ROWS

BACKGROUND OF THE INVENTION

This invention relates in general to devices for grooming hair, and in particular to a hair brush for use with a hot air blower, the hair brush having rows of bristles that are movable with respect to each other.

Blow dryers are in widespread use. These dryers discharge hot air onto the hair for quickly drying the hair. Usually, the hair will have a setting type gel that causes the hair to stay in approximately the same position at which it dries.

To assist in styling the hair, blow dryer brushes are used. A blow dryer brush is similar to a hair brush in that it has a handle portion and a bristle carrier portion. The bristle carrying portion, however, has holes extending through it for air from the blow dryer to pass through for assisting in drying the hair while the brush holds the hair in the desired place. Also, the bristles differ from the usual brush, these bristles being much larger in diameter and often having spherical tips on the ends.

While blow drying with blow dryer brushes provides the general contours and the body desired to the hair, it is not easy to provide waves and curls. One must be skilled in manipulating the brush to dry the hair to provide waves and curls.

SUMMARY OF THE INVENTION

A blow dryer brush is provided with this invention that has features to easily enable the placing of waves and curls in the hair. The brush has a handle portion and a filament carrier portion. The filament carrier portion is divided into at least two sections, one stationary and one movable. Each section contains filaments for engaging hair. The movable section is movable with respect to the stationary section. This allows one to engage the hair in a first position, then shift the movable section to the second position. Engaged hair will form a curve between the portion that remains with the stationary section and the portion that remains with the movable section. Hot air from the blower discharged through apertures in the sections dries the hair in the desired position.

DESCRIPTION OF THE PREFERRED EMBODIMENT

Figures 1, 2, 3:
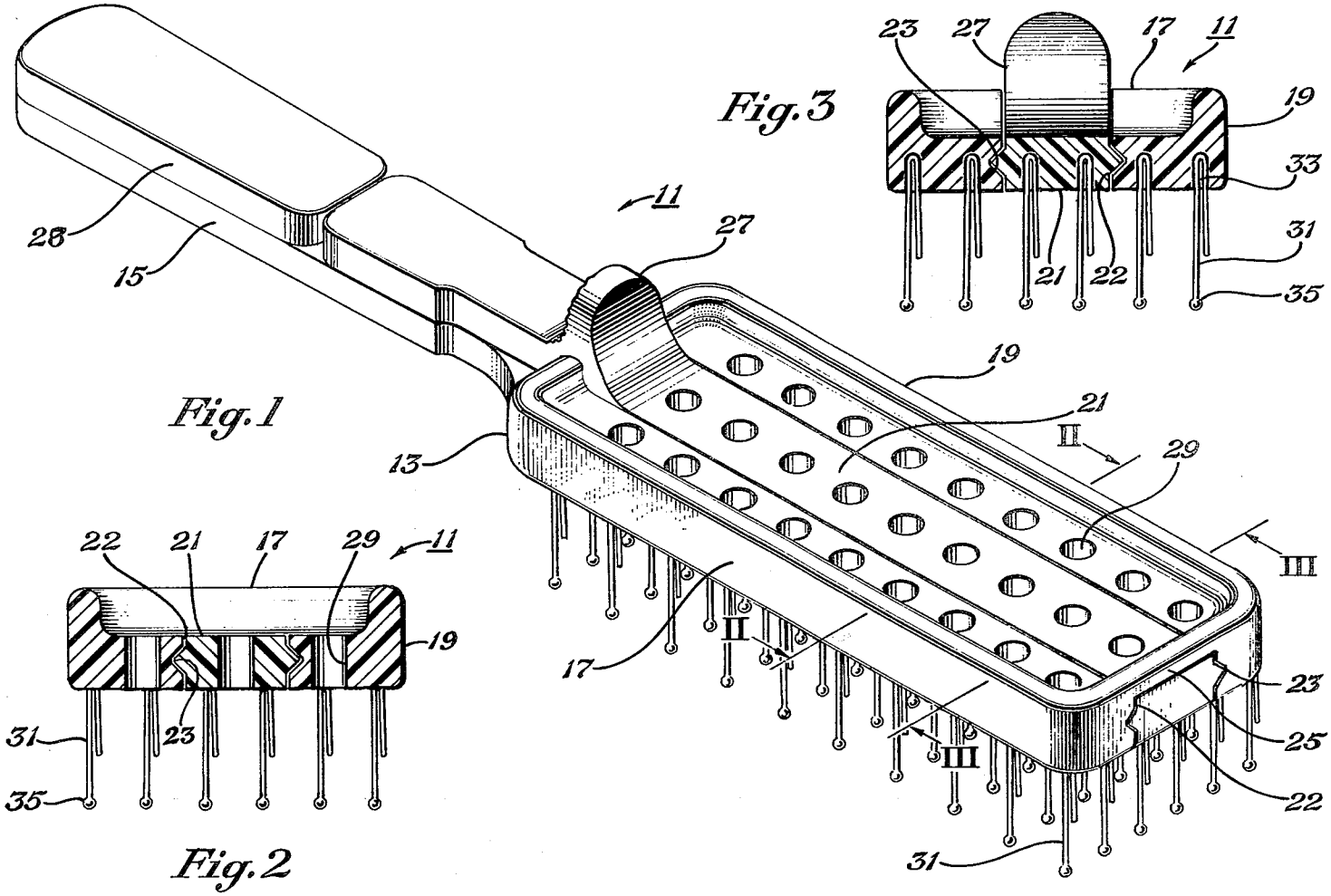
FIG. 1 is a perspective view of a brush constructed in accordance with this invention.
FIG. 2 is a sectional view of the brush of FIG. 1, taken along the line II—II.
FIG. 3 is a sectional view of the brush of FIG. 1, taken along the line III—III.

Referring to FIG. 1, hair brush 11 has a body 13, normally constructed of a plastic material. Body 13 has a handle 15 for gripping by the user. A filament carrier 17 extends from the handle 15. Filament carrier 17 is generally rectangular and has two outer or stationary sections 19 integrally formed with handle 15. Stationary sections 19 are spaced apart from each other and are identical, but for being mirror images of each other.

A longitudinal slot 22 is defined by the space between the stationary sections 19. A movable or intermediate section 21 is carried within this central slot 22. The sidewalls of the movable section 21 slidingly engage the opposing sidewalls of the stationary sections 19. A tongue and groove 23 formed on each mating sidewall of movable section 21 and stationary sections 19 retains movable section 21 with the filament carrier 17. Also, a bridge 25 joins the stationary sections 19 at the forward end of the brush to maintain the stationary sections 19 in alignment.

A thumb grip 27 protrudes upwardly from the upper surface of movable section 21. Thumb grip 27 enables the user to slide the movable section 21 parallel with the stationary sections 19. A portion of movable section 21 extends rearwardly from thumb grip 27 and slides on handle 15. A flat member 28 forms part of the handle 15 rearward of movable section 21. Member 28 is glued or otherwise fixed to the upper surface of the handle 15 and is generally rectangular in shape to facilitate gripping by the user.

Figure 4:
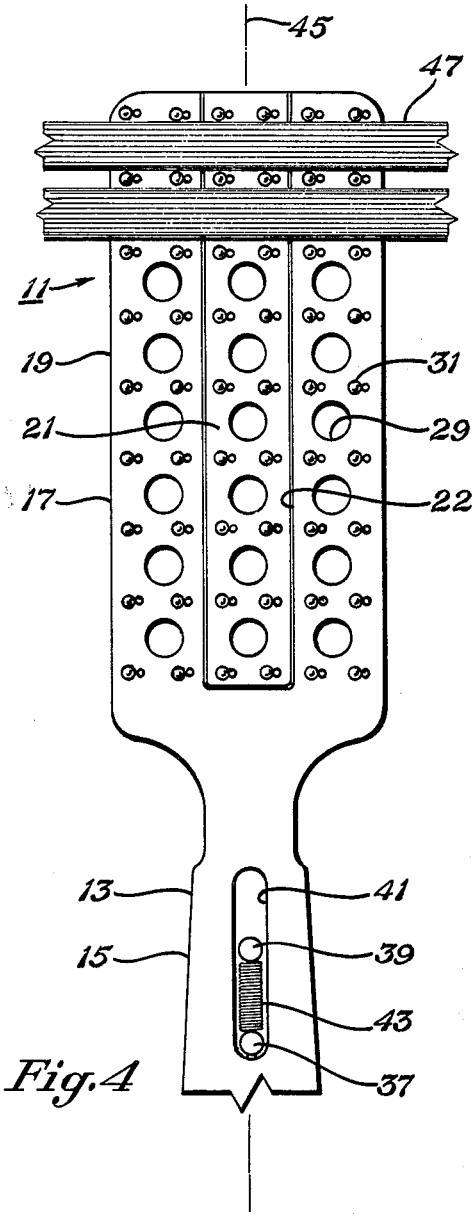
FIG. 4 is a partial bottom view of the brush of FIG. 1, shown in a first position.

As shown in FIG. 1, each stationary section 19 and the movable section 21 have a single, longitudinal row of spaced-apart holes 29. As shown in FIG. 2, these holes 29 extend completely through the filament carrier 17 so that hot air from a blow dryer can be discharged through the brush 11. Also, each stationary section 19 and movable section 21 have two longitudinal rows of bristles or filaments 31. The filaments 31 are of an elastomeric material and all face the same general direction as shown in FIG. 4. As shown in FIG. 3, each filament 31 is a single, cylindrical filament, pressed into a socket or hole 33 formed in filament carrier 17. The filament 31 is doubled-back into a "U", with the "U" being at the base of the hole 33. Normally, one end of filament 31 will be longer than the other end by an amount equal to about half the distance that the longer end protrudes from the hole 33. Each end of filament 31 has a spherical tip 35. As shown in FIG. 4, the holes 29 are staggered with the filaments 31.

Figure 5:
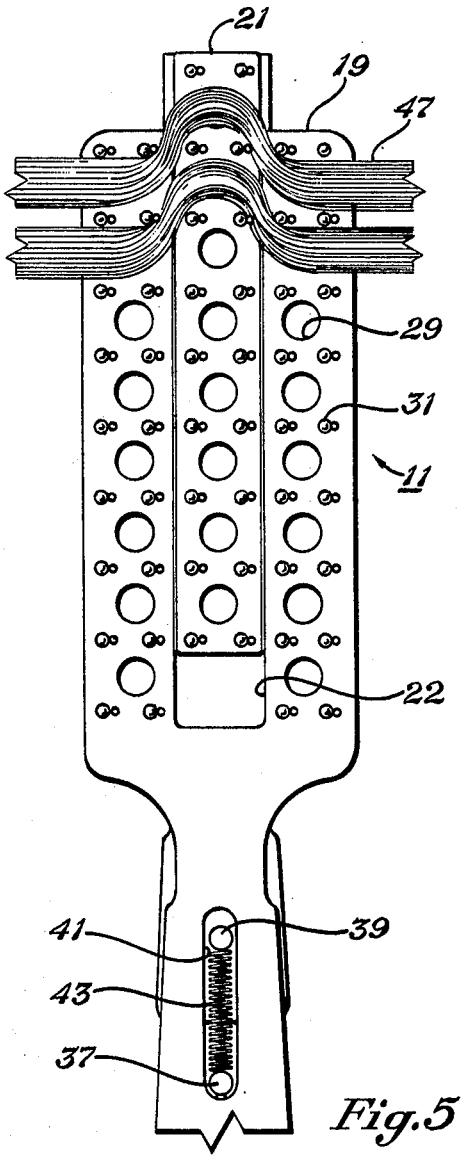
FIG. 5 is a partial bottom view of the brush of FIG. 1, shown in a second position.

As shown also in FIG. 4, the handle 15 has a pin 37 secured to it and spaced longitudinally from a pin 39 that is located on the bottom of movable section 21. Pins 37 and 39 are cylindrical protruberances, both located within an elongated slot 41 formed in handle 15. A spring 43 is stretched between pins 37 and 39. FIGS. 4 and 5 show that the spring 43 serves as a bias means for urging the movable section 21 rearwardly.

FIGS. 4 and 5 also show that the filament carrier 17 is longitudinally aligned with the handle 15, with the longitudinal axis 45 of each being common. Each row of filaments 31 is parallel with axis 45. Each row of holes 29 is parallel with axis 45. Also, when the movable section 21 is in its rearwardmost or aligned position, as shown in FIG. 4, the filaments are laterally aligned. That is, as defined herein, a line may be drawn perpendicular to axis 45 and through each adjacent filament socket 33 in the sections 19 and 21. The rearwardmost filaments 31 of the movable section 21 laterally align with the rearwardmost filaments 31 of the stationary section 19 when in this first position shown in FIG. 4. Note that in the misaligned or forward position of FIG. 5., a line perpendicular to axis 45 can be drawn through sockets 33 (FIG. 3) in the stationary sections 19 and movable section 21. However, in this position, the sockets 33 are not laterally aligned as defined herein since the movable section 21 is shifted forwardly a distance equal to the distance between longitudinally adjacent sockets 33.

In operation, brush 11 may be used as a conventional brush to groom the hair. It may also be used to form waves as shown in FIGS. 4 and 5. The user places strands 47 of hair through the filaments 31 perpendicular to longitudinal axis 45. Although only two strands 47 are shown, the strands likely would extend the full length of filament carrier 17. The user then uses his thumb to move the movable section 21 forwardly from the aligned position shown in FIG. 4 to a second or misaligned position shown in FIG. 5. The filaments 31 of the movable section 21 move along longitudinal axis 45 with respect to the filaments 31 in the stationary sections 19. The strands 47 remain engaged with each section 19 and 21, causing a wave to be created in the strands 47. The user then places a blow dryer (not shown) on one of the sides of the filament carrier 17 and discharges air through holes 29 to dry the strands 47 in the wave configuration shown in FIG. 5. Once dry, the brush 11 is drawn away from the hair and the spring 43 is allowed to shift the movable section 21 back to the aligned position shown in FIG. 4.

For making curls (not shown), the user can wrap a strand 47 around the protruding end of movable section 21 when in the second position shown in FIG. 5. The user then relaxes the grip, allowing the spring 43 to compress the strand 47 against the forward ends of the stationary sections 19 and the bridge 25 (FIG. 1). Spring 43 retains the curl in compression while the user then uses a blow dryer to dry the strand 47.

The invention has significant advantages. The movable section allows one to easily place waves and curls in hair by using a blow dryer. The device is simple in construction.

While the invention has been shown in only one of its forms, it should be apparent to those skilled in the art that it is not so limited but is susceptible to various changes without departing from the scope of the invention.

I claim:

1. A hair brush for use with a separate hot air blower, comprising in combination:

a body having on a forward end a filament carrier portion and on a rearward end a handle portion;

the filament carrier portion having two outer sections with an intermediate section located therebetween;

each of the sections having an upper side and a lower side with at least one row of filaments protruding from the lower side;

the intermediate sections and the outer sections being movable with respect to each other from an aligned position in which the filaments of the intermediate section are aligned with the filaments of the outer sections in a lateral direction, to a misaligned position in which the forward end of the intermediate section protrudes past the forward ends of the outer sections; and bias means for urging the sections from the misaligned position to the aligned position.

2. A hair brush for use with a separate hot air blower, comprising in combination:

a body having on a forward end a filament carrier portion and on a rearward end a handle portion;

the filament carrier portion having two outer sections with an intermediate section located therebetween;

each of the sections having an upper side and a lower side with at least one row of filaments protruding from the lower side;

at least one of the sections having a plurality of apertures extending therethrough from the upper side to the lower side for the passage of hot air between the filaments from the hot air blower;

the intermediate section and the outer sections being movable with respect to each other from a rearward position in which the forward end of the intermediate section is flush with the forward ends of the outer sections to a forward position in which the forward end of the intermediate section protrudes past the forward ends of the outer sections; and bias means for urging the sections from the forward position to the rearward position.

3. A method of forming curls in hair, comprising:

providing a brush with a filament carrier portion having two outer sections and an intermediate section therebetween, each of the sections having at least one longitudinal row of filaments that will align laterally in an aligned portion, the intermediate section and outer sections being movable with respect to each other to a misaligned position in which the intermediate section protrudes past the forward ends of the outer sections; the filament carrier further having spring means for urging the sections to the aligned position;

moving the sections to the misaligned position; then winding a strand of hair in a curl around the portion of the intermediate section protruding past the outer sections; then releasing the sections to allow the spring means to urge the sections toward the aligned position, the curl of hair contacting the ends of the outer section, preventing the return to the aligned position, the curls being restrained from unwinding by the force of the spring means; then blowing air on the curl to cause the hair to dry with the wave in place; then again urging the sections to the misaligned position and unwinding the hair from the brush.

4. The method according to claim 3, further including the steps of forming a wave in the hair, comprising:

placing strands of hair transversely through the filaments when the sections are in the aligned position; then moving the sections to the misaligned position to misalign the filaments on the outer section with the filaments on the intermediate section, creating a wave in the hair; then blowing hot air on the hair between the filaments to cause the hair to dry with the wave in place; then removing the hair from the brush.

* * * * *